US006529190B2

(12) United States Patent
Jiang et al.

(10) Patent No.: US 6,529,190 B2
(45) Date of Patent: Mar. 4, 2003

(54) METHOD AND APPARATUS FOR MONITORING/SHUTTING DOWN A POWER LINE WITHIN A DISPLAY DEVICE

(75) Inventors: Libiao Jiang, San Diego, CA (US); Toshiro Kawata, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/163,611

(22) Filed: Sep. 30, 1998

(65) Prior Publication Data

US 2001/0022583 A1 Sep. 20, 2001

(51) Int. Cl.[7] ..... G09G 5/00

(52) U.S. Cl. ..... 345/211; 345/211; 345/212; 345/214

(58) Field of Search ..... 345/211, 212, 345/214, 52; 323/248

(56) References Cited

U.S. PATENT DOCUMENTS 4,740,828 A * 4/1988 Kinoshita ..... 348/341
4,820,023 A * 4/1989 Ohsawa ..... 345/211
4,999,730 A 3/1991 Pickard
5,028,914 A * 7/1991 Povenmire ..... 345/440.1
5,319,514 A 6/1994 Walsh et al.
5,481,730 A * 1/1996 Brown et al. ..... 395/750
5,497,332 A 3/1996 Allen et al.
5,555,032 A * 9/1996 Kung ..... 345/211
5,555,483 A 9/1996 Pressman et al.
5,635,824 A * 6/1997 Noguchi ..... 323/284
5,880,719 A * 3/1999 Kikinis ..... 345/212
5,938,770 A * 8/1999 Kim ..... 345/212
6,222,370 B1 4/2001 Schousek et al.

* cited by examiner

*Primary Examiner*—Richard Hjerpe
*Assistant Examiner*—Duc Q Dinh
(74) *Attorney, Agent, or Firm*—Blakely, Sokoloff, Taylor & Zafman LLP

(57) ABSTRACT

A method and apparatus for monitoring and/or shutting down a power line in, for example, a display device is described. In one embodiment, a method comprises converting a voltage on a power line to a digital value, comparing the digital value with a predetermined value, and shutting down a power supply if the digital value is below the predetermined value for a predetermined amount of time.

26 Claims, 2 Drawing Sheets

METHOD AND APPARATUS FOR MONITORING/SHUTTING DOWN A POWER LINE WITHIN A DISPLAY DEVICE

BACKGROUND OF THE INVENTION

1. Field of the Invention

The present invention relates generally to the field of display devices, and more specifically, to a method and apparatus for monitoring and/or shutting down a power line contained therein.

2. Background Information

A monitor typically includes a power supply that delivers a plurality of direct current ("DC") voltages to various circuits within the monitor. These DC voltages range from a high voltage (e.g., 180 volts) to a lower voltage (e.g., 5 volts). One of the lower DC voltages is referred to as the B+ power line, which typically provides power to various low voltage circuits contained within the monitor. To ensure safety within a monitor, a fuse is placed in series with the low B+ power line for providing overcurrent protection due to line shortages and the like. The monitor may also include other hardware circuitry for monitoring the low B+ power line for line shortages. However, this type of circuitry is expensive, unreliable, difficult to change during the design process, and difficult to recover from.

Accordingly, there is a need in the technology for a method and apparatus for overcoming the aforementioned drawbacks.

SUMMARY OF THE INVENTION

The present invention is a method and apparatus for monitoring and/or shutting down a power line in, for example, a display device. In one embodiment, a method comprises converting a voltage on a power line to a digital value, comparing the digital value with a predetermined value, and shutting down a power supply if the digital value is below the predetermined value for a predetermined amount of time.

DETAILED DESCRIPTION

Figure 1:
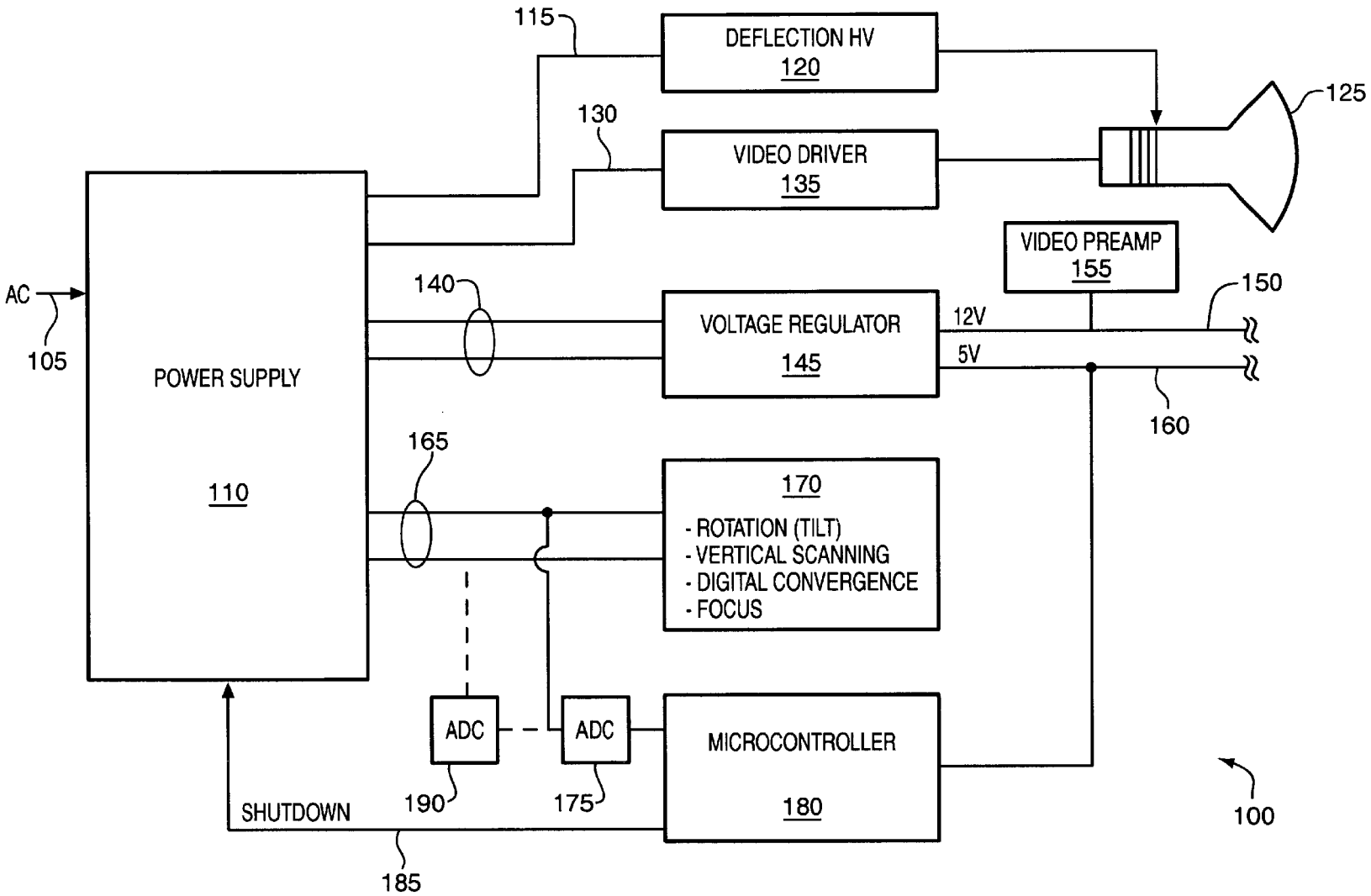
FIG. 1 illustrates a block diagram of exemplary functional blocks within a display device, according to one embodiment of the present invention.

FIG. 1 illustrates a block diagram of exemplary functional blocks within a display device 100, according to one embodiment of the present invention. In the embodiment shown, the display device is a computer monitor. The present invention may be practiced with any other type of display device, such as, for example, a television set. Referring to FIG. 1, the display device 100 includes a power supply 110 that receives an alternating current ("AC") input voltage 105, typically 110V or 220V, and provides several direct current ("DC") voltages for powering different functional blocks within the display device. More specifically, the power supply 110 provides a first high voltage DC line 115 (e.g., 180V), for powering a high-voltage, deflection circuit 120. The high-voltage deflection circuit 120 generates a high-voltage (e.g., on the order of 15–30 kilovolts, "KVs") and applies the high-voltage to a cathode ray tube ("CRT") 125. Although a CRT display is shown in FIG. 1, the present invention may be used with different types of displays such as, but not limited or restricted to, liquid-crystal displays ("LCDs"), plasma displays, and any other devices that convert an electrical signal into a viewable image. That is, the type of display used is irrelevant to the teachings of the present invention.

The power supply 110 provides a second high voltage DC line 130 (e.g., 80V), for powering a video driver circuit 135. The video driver circuit 135 converts a small video signal into a larger signal for driving the CRT 125, and regulates the strength of the electron beam by adjusting the signal strength. In addition, the power supply 110 provides low voltage DC lines 140 (hereinafter referred to as the "B+ power lines"), generated by a first rectifier circuit (not shown) within the power supply 110. Typically, the B+ power lines 140 include positive and negative DC voltage lines (e.g., +16V and −16V). The B+ power lines 140 are applied to a voltage regulator circuit 145. The voltage regulator circuit 145 provides regulated DC voltage lines 150 (e.g., 12V) and 160 (e.g., 5V). The regulated DC voltage line 150 is used to power, for example, a video preamplifier circuit 155. The regulated DC voltage line 160 is used to power lower voltage circuits such as, for example, a microcontroller 180.

The power supply 110 further provides a second low voltage DC lines 165, generated by a second rectifier circuit (not shown) within the power supply 110. The second B+ power lines 165 also include positive and negative DC voltage lines (e.g., +16V and −16V). These positive and negative DC voltage lines are applied to other circuits, as shown by numeral 170. These circuits include, for example, a rotation circuit which controls the picture tilt, a vertical deflection circuit which controls the vertical scanning of the CRT, a digital convergence circuit which converges the red, green, and blue channels on one spot on the CRT, and a focus circuit. The circuits listed in block 170 are merely exemplary and not exhaustive.

In the embodiment of FIG. 1, one of the B+ power lines 165 (e.g., positive or negative) is applied to an analog-to-digital converter ("ADC") 175, which is in turn coupled to the microcontroller 180. The ADC 175 is external to the microcontroller 180, although it is contemplated that the ADC 175 may be contained within the microcontroller 180. A microcontroller is broadly defined as a device (or two or more devices), in a single package or on a board, that processes data including the capability to perform arithmetic functions such as additions, multiplications, etc. The ADC 175 converts the analog DC voltage value on the B+ power line into a digital value and provides the same to the microcontroller 180.

In one embodiment, a translation circuit (not shown) may be placed between a power line that is monitored (e.g., one of the B+ power lines 165) and the ADC 175 in order to translate the voltage on the power line (which may be at any voltage, 16V, 80V, −16V, etc.), to a predetermined voltage range (e.g., 0 to 5 volts). If an 80V-power line has a voltage range between 0–100 volts, the translation circuit will translate the voltage range between, for example, 0–5 volts. Thus, eighty volts on the power line (input of the translation circuit) would correspond to four volts (output of the translation circuit). The resolution of the ADC 175 may be any number of bits such as four, eight, sixteen, etc. However, for sake of illustration of the present invention, it is assumed that the ADC 175 has a resolution of eight-bits.

The microcontroller 180 includes a register file for temporarily storing data. Random access memory ("RAM")

and/or read only memory ("ROM") may be contained within the microcontroller 180 and/or external to the microcontroller 180. Continuing to refer to FIG. 1, the microcontroller 180 periodically monitors the output of the ADC 175, and hence the status of one of the B+ power lines 165. Thus, if the B+ power line 165 falls below a lower threshold voltage, indicating a line shortage condition, the microcontroller will detect such a condition and shut down the power supply 110. On the other hand, if the B+ power line 165 rises above a ceiling threshold voltage, indicating an over-voltage condition, the microcontroller will detect such a condition and take appropriate action. When the monitor 100 is first powered up, the microcontroller 180 waits for a predetermined time period (e.g., two seconds) before reading the digital values outputted by the ADC 175, allowing the B+ voltage line 165 to settle to its steady state. In addition, the microcontroller 180 may monitor more than one power line. In such a case, two or more ADC converter channels (or separate ADCs 190) may be used to provide the digital values of the corresponding power lines to the microcontroller 180.

The microcontroller 180 periodically (e.g., every 32 milliseconds, "ms") reads the digital values outputted by the ADC 175, which is referred to as the "sampling time". During each sampling time, the microcontroller 180 also compares the digital value read from the ADC 175 with a first predetermined threshold value and a second predetermined threshold value. The first predetermined threshold value is a value for determining whether a line shortage condition is deemed to exist. If the digital value read from the ADC 175 is lower than the first predetermined threshold value (in the case of a positive voltage line or when the digital value is the absolute value of the voltage line), a counter is incremented by one, otherwise the counter is reset to zero. To prevent a false detection of a shutdown condition (e.g., an instantaneous voltage spike), the B+ power line 165 must be below the first predetermined threshold value for a predetermined number of consecutive sample times before a shutdown condition is deemed to exist. Thus, if the counter reaches a predetermined count (hereinafter referred to as "SHUTDOWN COUNT"), indicating that the B+ power line 165 has fallen below the first predetermined threshold value for a predetermined amount of time, a shutdown condition exists:. In such a condition, the microcontroller 180 asserts a SHUTDOWN signal on signal line 185, causing the power supply 110 to shut down. When the power supply 110 is shut down, all the power lines (115, 130, 140, and 165) are at approximately zero volts.

The second predetermined threshold value is a value for determining whether an over-voltage condition is deemed to exist. If the digital value read from the ADC 175 is higher than the second predetermined threshold value, a second counter is incremented by one, otherwise the second counter is reset to zero. To prevent a false detection of a shutdown condition (e.g., an instantaneous voltage spike), the B+ power line 165 must be above the second predetermined threshold value for a predetermined number of consecutive sample times before a shutdown condition is deemed to exist. Thus, if the second counter reaches a second predetermined count, indicating that the B+ power line 165 has risen above the second predetermined threshold value for a predetermined amount of time, a shutdown condition exist. In such a condition, the microcontroller 180 asserts a SHUTDOWN signal on signal line 185, causing the power supply 110 to shut down. When the power supply 110 is shut down, all the power lines (115, 130, 140, and 165) are at approximately zero volts.

The first and second predetermined threshold values may be stored in the ROM and loaded into registers after a reset or power up of the display device 100. Alternatively, the first and second predetermined threshold values may be set by a dip switch during factory installation of the monitor. The microcontroller 180 obtains the digital values by polling the ADC 175 every sampling time. In another embodiment, another device, such as a clocking circuit, may generate an interrupt to the microcontroller 180 every sampling time, during which time the microcontroller 180 may call an interrupt service routine to obtain the digital values. In either case, an exemplary process is illustrated in FIG. 2.

An example is provided to illustrate the present invention. Assuming the B+ power line 165 that is monitored is a positive 16V line, the range of voltages for the power line may be set between, for example, 0 and 20 volts. (This range is merely exemplary and may be altered to any desired voltage range.) With an eight-bit ADC 175, zero volts refers to digital value 0 and twenty volts refers to digital value 255, such that the resolution of the ADC 175 is 0.078 volts, i.e., the difference between two adjacent digital values corresponds to about 0.078 volts. Thus, the 16V power line corresponds to a digital value of approximately 204, indicating the normal condition of the power line.

A lower predetermined threshold voltage is set at, for example, 5V, corresponding to a digital value of approximately 63, and an upper predetermined threshold voltage is set at, for example, 18V, corresponding to a digital value of approximately 229. If the digital value read is 63 or less for a predetermined time period, a line shortage condition is deemed to exist. On the other hand, if the digital value read is 229 or higher for a predetermined time period, an over-voltage condition is deemed to exist. In either case, the microcontroller 180 shuts down the power supply 110 by way of the SHUTDOWN signal line 185. As can be seen from the aforementioned example, the present invention is extremely flexible in that the power line that is monitored can be at any voltage (e.g., 180V, −20V), and the voltage range, threshold value, and resolution can be selected to any desired set of values.

Figure 2:
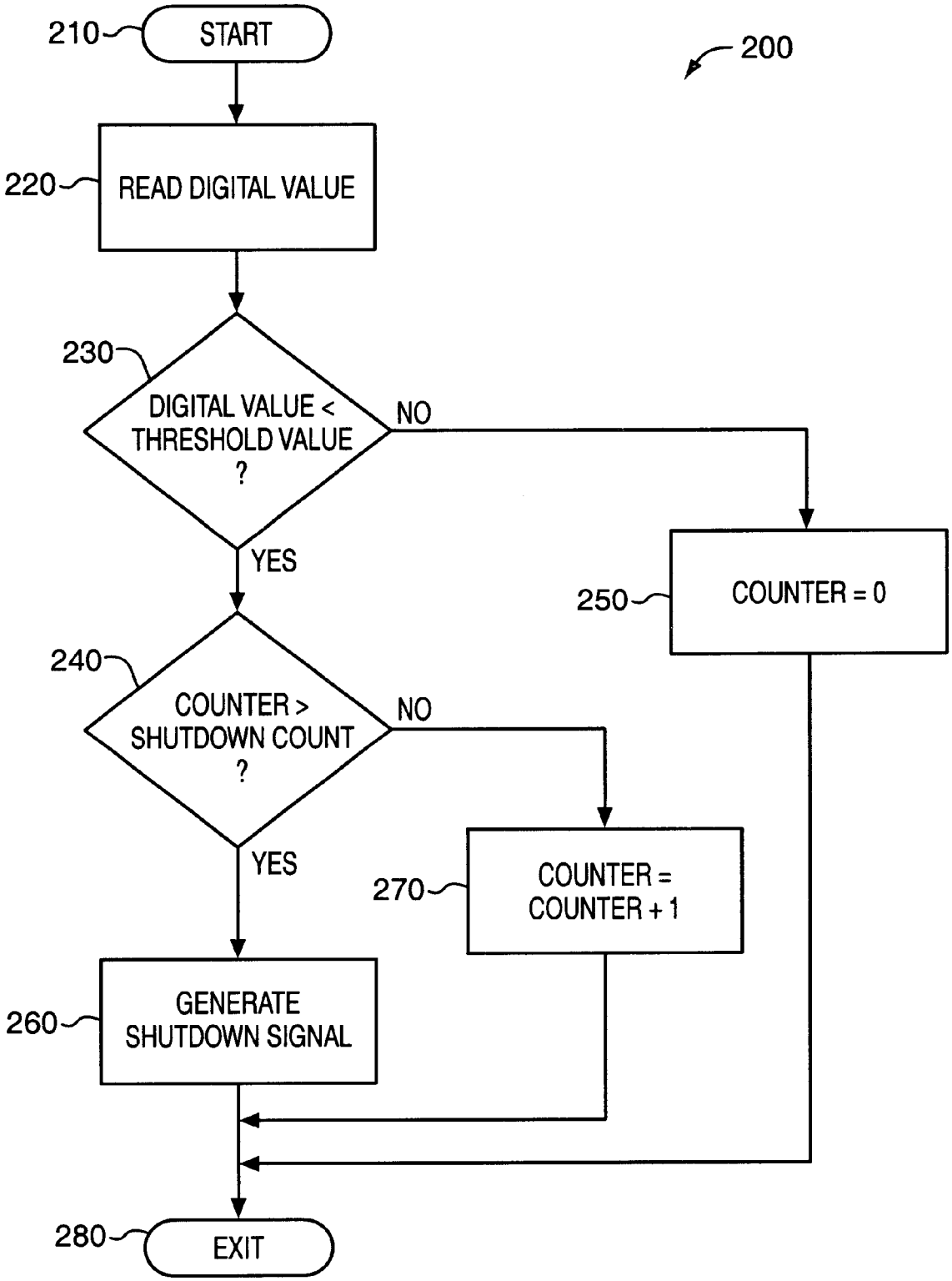
FIG. 2 is a flow diagram illustrating a process for monitoring and/or shutting down a power line, according to one embodiment of the present invention.

FIG. 2 is a flow diagram illustrating a process 200 for monitoring and/or shutting down a power line, according to one embodiment of the present invention. Referring to FIG. 2, the process 200 commences at block 210. At block 220, the digital value output by the ADC 175 is read. The process then moves to block 230, where the digital value is compared with a predetermined threshold value, where the threshold value may be user selectable or selected during factory setting of the display device 100. If the digital value is less than (or equal to) the threshold value, the process continues to block 240, otherwise the process moves to block 250 where a counter is set to zero, indicating that the power line has not triggered a possible shutdown condition. The process then ends at block 280.

At block 240, if the counter value is greater than (or equal to) a predetermined shutdown count, indicating that the power line has been below the threshold value for a predetermined amount of time, the process continues to block 260. At block 260, the microcontroller 180 asserts the SHUTDOWN signal on signal line 185, causing the power supply 110 to shut down. The process then ends at block 280. On the other hand, at block 240, if the counter value is less than the shutdown count, indicating that the power line has been below the threshold value for less than the predetermined amount of time, the process moves to block 270. At block 270, the counter is incremented by one and the process ends at block 280. The exemplary process 200 involves monitoring a positive power line for a line shortage condition. A similar process may be implemented for an over-voltage condition or a for a negative voltage power line.

By converting a voltage of a power line to a digital value and monitoring the digital value utilizing a controller, the present invention provides greater flexibility while reducing the cost. The power line that is monitored can be at any voltage, and the voltage range, threshold value, and resolution can be set to any desired value.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method comprising:

detecting a voltage for each of a plurality of power supply lines in a display device, the power supply lines being direct current lines;

converting each voltage for the plurality of power supply lines into a digital voltage value;

periodically monitoring each digital voltage value;

comparing each digital voltage value with a predetermined high voltage threshold for the respective power supply line and with a predetermined low voltage threshold for the respective power supply line, the high voltage threshold corresponding to an over-voltage condition for the display device and the low voltage threshold corresponding to a line shortage condition for the display device; and shutting down a power supply supplying power to the plurality of power supply lines if:

the digital voltage value for any of the plurality of power supply lines is above the high voltage threshold for the respective power supply line for a first predetermined period of time; or the digital voltage value for any of the plurality of power supply lines is below the low voltage threshold for the respective power supply line for a second predetermined period of time.

2. The method of claim 1, wherein the high voltage threshold for a first power supply line is different from the high voltage threshold for a second power supply line.

3. The method of claim 2, wherein the low voltage threshold for the first power supply line is different from the low voltage threshold for the second power supply line.

4. The method of claim 1, further comprising translating a voltage on one of the plurality of power supply lines to a different voltage range.

5. A protection mechanism for a display device comprising:

a first analog-to-digital converter coupled to a first power supply line to convert a first voltage of the first power supply line to a first digital voltage value, the first power supply line being a direct current power line;

a second analog-to-digital converter coupled to a second power supply line to convert a second voltage of the second power supply line to a second digital voltage value, the second power supply line being a direct current power line; and a microcontroller to:

periodically monitor the first digital voltage value and the second digital voltage value, compare the first digital voltage value with a first predetermined high voltage threshold and with a first predetermined low voltage threshold and compare the second digital voltage value with a second predetermined high voltage threshold and with a second predetermined low voltage threshold, the first and second high voltage thresholds corresponding to over-voltage conditions for the display device and the first and second low voltage thresholds corresponding to line shortage conditions for the display device, and shut down a power supply supplying power to the first power supply line and the second power supply line if:

the first digital voltage value is above the first high voltage threshold for a first predetermined time period;

the first digital voltage value is below the first low voltage threshold for a second predetermined time period;

the second digital voltage value is above the second high voltage threshold for a third predetermined time period; or the second digital voltage value is below the second low voltage threshold for a fourth predetermined time period.

6. The mechanism of claim 5, wherein the first high voltage threshold is different than the second high voltage threshold.

7. The mechanism of claim 5, wherein the first low voltage threshold is different than the second low voltage threshold.

8. The mechanism of claim 5, wherein the microcontroller polls the first digital voltage value and the second digital voltage value at a specified interval of time.

9. The mechanism of claim 5, wherein the microcontroller monitors the first digital voltage value and the second digital voltage value upon receiving an interrupt signal.

10. The mechanism of claim 5, wherein the microcontroller waits a predetermined period of time after reset or power up of the display device before beginning to monitor the first digital voltage value and the second digital voltage value.

11. The mechanism of claim 5, further comprising a memory to store digital voltage values.

12. The mechanism of claim 5, further comprising a read only memory to store the high voltage thresholds and the low voltage thresholds.

13. The mechanism of claim 5, wherein the high voltage thresholds and the low voltage thresholds are loaded into memory registers upon reset or power up of the display device.

14. The mechanism of claim 5, wherein the microcontroller:

increments a first counter when a digital voltage value for the first power supply line is above the high voltage threshold for the first power supply line; and resets the first counter when the digital voltage value for the first supply line is equal to or below the high voltage threshold for the first power supply line;

increments a second counter when the digital voltage value for the first power supply line is below the low voltage threshold for the first power supply line and resets the second counter when the digital voltage value for the first power supply line is equal to or above the low voltage threshold for the first power supply line;

increments a third counter when a digital voltage value for the second power supply line is above the high voltage threshold for the second power supply line and resets the third counter when the digital voltage value for the second supply line is equal to or below the high voltage threshold for the second power supply line;

increments a fourth counter when the digital voltage value for the second power supply line is below the low voltage threshold for the second power supply line and resets the fourth counter when the digital voltage value for the second power supply line is equal to or above the low voltage threshold for the second power supply line; and using the counters, determines the time period during which the voltage of the first or second power supply line is above the high voltage threshold for the respective power supply line or is below the low voltage threshold for the respective power supply line.

15. A display device comprising:

a power supply to receive an alternating current signal and provide a first voltage on a first power supply line and a second voltage on a second power supply line, the first and second power supply lines being direct current lines;

one or more functional circuits coupled to the first power supply line and one or more functional circuits coupled to the second power supply line;

a first analog-to-digital converter coupled to the first power supply line to convert the voltage thereon to a first digital voltage value;

a second analog-to-digital converter coupled to the second power supply line to convert the voltage thereon to a second digital voltage value; and a microcontroller to:

read the first digital voltage value and the second digital voltage value, compare the first digital voltage value with a first predetermined high voltage threshold and a first predetermined low voltage threshold and compare the second digital voltage value with a second predetermined high voltage threshold and a second predetermined low voltage threshold, the first and second high voltage thresholds corresponding to over-voltage conditions for the display device and the low voltage threshold corresponding to line shortage conditions for the display device, and shut down the power supply if:

the first digital voltage value is above the first high voltage threshold for a first predetermined time period;

first digital voltage value is below the first low voltage threshold for a second predetermined time period;

the second digital voltage value is above the second high voltage threshold for a third predetermined time period; or the second digital voltage value is below the second low voltage threshold for a fourth predetermined time period.

16. The display device of claim 15, wherein the first high voltage threshold is different than the second high voltage threshold.

17. The display device of claim 15, wherein the first low voltage threshold is different than the second low voltage threshold.

18. The display device of claim 15, wherein the microcontroller polls the first digital voltage value and the second digital voltage value at a specified interval of time.

19. The display device of claim 15, wherein the microcontroller monitors the first digital voltage value and the second digital voltage value upon receiving an interrupt signal.

20. The display device of claim 15, wherein the microcontroller waits a predetermined period of time after reset or power up of the display device before beginning to monitor the first digital voltage value and the second digital voltage value.

21. The display device of claim 15, further comprising a memory to store digital voltage values.

22. The display device of claim 15, further comprising a read only memory to store the first and second high voltage thresholds and the first and second low, voltage thresholds.

23. The display device of claim 15, wherein the first and second high voltage thresholds and the first and second low voltage thresholds are loaded into memory registers upon reset or power up of the display device.

24. The display device of claim 15, wherein the microcontroller:

increments a first counter when a digital voltage value for the first power supply line is above the high voltage threshold for the first power supply line and resets the first counter when the digital voltage value for the first supply line is equal to or below the high voltage threshold for the first power supply line;

increments a second counter when the digital voltage value for the first power supply line is below the low voltage threshold for the first power supply line and resets the second counter when the digital voltage value for the first power supply line is equal to or above the low voltage threshold for the first power supply line;

increments a third counter when a digital voltage value for the second power supply line is above the high voltage threshold for the second power supply line and resets the third counter when the digital voltage value for the second supply line is equal to or below the high voltage threshold for the second power supply line;

increments a fourth counter when the digital voltage value for the second power supply line is below the low voltage threshold for the second power supply line and resets the fourth counter when the digital voltage value for the second power supply line is equal to or above the low voltage threshold for the second power supply line; and using the counters, determines the time period during which the voltage of the first or second power supply line is above the high voltage threshold for the respective power supply line or is below the low voltage threshold for the respective power supply line.

25. A display device comprising:

a power supply to receive an alternating current signal and provide a voltage on each of a plurality of power supply lines, the plurality of power supply lines being direct current lines;

one or more functional circuits coupled to each of the plurality of power supply lines;

an analog-to-digital converter to convert the voltage of each of the plurality of power supply lines to a digital voltage value; and a microprocessor to:

periodically monitor each of the digital voltage values, compare each digital voltage value with a predetermined high voltage threshold for the respective power supply line and a first predetermined low voltage threshold for the respective power supply line, each high voltage threshold corresponding to an over-voltage condition for the display device and each low voltage threshold corresponding to a line shortage condition for the display device, count the number of times each digital voltage value is above the predetermined high voltage threshold for the respective power supply line and reset the count for any digital voltage value to zero when the digital voltage value is equal to or below the predetermined high voltage threshold for the respective power supply line;

count the number of times each digital voltage value is below the predetermined low voltage threshold for the respective power supply line and reset the count for any digital voltage value to zero when the digital voltage value is equal to or above the predetermined low voltage threshold for the respective power supply line; and shut down the power supply if the digital voltage value for any of the plurality of power supply lines is:

above the predetermined high voltage threshold for the respective power supply line for a first predetermined period of time established for the respective power line, or below the predetermined low voltage threshold for the respective power supply line for a second predetermined period of time established for the respective power line.

26. A method comprising:

detecting a voltage for each of a plurality of power supply lines in a display device, the plurality of power supply lines being direct current lines;

translating the detected voltage on each of the plurality of power supply lines to a predetermined voltage range;

converting each voltage for the plurality of power supply lines into a digital voltage value;

periodically monitoring each digital voltage value;

comparing each digital voltage value with a predetermined high voltage threshold and with a predetermined low voltage threshold, the high voltage threshold corresponding to an over-voltage condition for the display device and the low voltage threshold corresponding to a line shortage condition for the display device;

determining the length of time each digital voltage value is continuously above the high voltage threshold or is continuously below the low voltage threshold; and shutting down a power supply supplying power to the plurality of power supply lines if:

the digital voltage value for any of the plurality of power supply lines is continuously above the high voltage threshold for a first predetermined period of time; or the digital voltage value for any of the plurality of power supply lines is continuously below the low voltage threshold for a second predetermined period of time.

* * * * *